US006153100A

United States Patent [19]

Mitchell

[11] Patent Number: 6,153,100

[45] Date of Patent: Nov. 28, 2000

[54] REMOVING IRON SALTS FROM NGL STREAMS

[75] Inventor: Kent E. Mitchell, Bartlesville, Okla.

[73] Assignee: Phillips Petroleum Company, Bartlesville, Okla.

[21] Appl. No.: 09/222,657

[22] Filed: Dec. 30, 1998

[51] Int. Cl.[7] ..... B01D 11/04

[52] U.S. Cl. ..... 210/634; 208/235; 208/236; 210/639; 210/709; 210/712; 210/724; 210/748; 210/912; 423/150.1; 585/818

[58] Field of Search ..... 48/198.3; 208/230, 208/235, 236; 210/712, 724, 725, 729, 912, 748, 634, 639, 709; 423/140, 150.1; 585/818

[56] References Cited

U.S. PATENT DOCUMENTS

| | | | |
|---|---|---|---|
| 3,642,430 | 2/1972 | Benson | 23/2 R |
| 3,740,331 | 6/1973 | Anderson | 210/53 |
| 4,370,236 | 1/1983 | Ferguson | 210/634 |
| 4,500,324 | 2/1985 | Vuong | 48/197 R |
| 4,931,164 | 6/1990 | Dickakian | 208/48 AA |
| 5,127,231 | 7/1992 | Larue et al. | 55/68 |
| 5,190,662 | 3/1993 | Keller et al. | 210/673 |

*Primary Examiner*—Peter A. Hruskoci
*Attorney, Agent, or Firm*—Richmond, Hitchcock, Fish & Dollar

[57] ABSTRACT

The aqueous wash stream of an electrolytic precipitation system treating natural gas liquid (NGL) is maintained at a pH sufficiently basic to decrease the solubility of iron sulfide in the aqueous wash stream.

13 Claims, No Drawings

REMOVING IRON SALTS FROM NGL STREAMS

FIELD OF THE INVENTION

This invention relates to hydrocarbon processing. In another aspect, the invention relates to the purification of natural gas liquids. In yet another aspect, the invention relates to an improved process employing an electrostatic precipitator for purifying a natural gas liquid (NGL) stream. In still another aspect, the invention relates to decreasing the amount of iron salts in the hydrocarbon effluent from an electrostatic precipitator.

BACKGROUND OF THE INVENTION

Among the naturally occurring contaminants in NGL pipelines is hydrogen sulfide which frequently attacks the interior surface of the pipeline thereby forming particulate iron sulfide. It is difficult to remove these particles from the NGL because many of them are in the micron size range. One of the methods used for removal of these particles is to contact the NGL stream with an aqueous wash liquid thereby forming a mixture having a hydrocarbon phase in which an aqueous phase is highly dispersed as droplets. This mixture is passed through an electrostatic precipitator wherein the particulate matter is drawn with the coalescing water droplets to the lower portion of the vessel (with the aid of gravity to the bottom of the vessel) while the hydrocarbon phase rises to the upper portion of the vessel. The purified hydrocarbon phase is removed from the vessel and passed on to further processing while the aqueous phase is removed from the vessel and filtered to remove the particulate contaminants. At least a portion of the water from which the particulates have been removed is recycled to the process as wash liquid.

Unfortunately, iron sulfide is soluble in water. A sufficient amount of iron sulfide is dissolved in the aqueous wash liquid and a sufficient amount of the wash liquid is entrained in the hydrocarbon effluent from the electrostatic precipitator that, due to changes in the operating conditions downstream of the precipitator, iron sulfide precipitates in apparatus downstream of the precipitator. The process and apparatus described above is set out in U.S. Pat. No. 4,370,236, the disclosure of which is incorporated here by reference. Decreasing the amount of dissolved iron sulfide in the hydrocarbon effluent from the electrostatic precipitator is the problem solved by the process of this invention.

SUMMARY OF THE INVENTION

It is therefore an object of this invention to provide a method for maximizing the removal of solid, iron salt contaminants from an NGL stream.

It is another object of this invention to prevent iron salt contamination of water used to wash collected solids from an NGL stream.

It is another object of this invention to reduce the amount of iron salt contamination caused in an NGL stream by water entrained in the NGL stream from an electrostatic precipitation process.

It is a further object of this invention to minimize the dissolving of soluble, iron sulfide contaminant into water contacting an NGL stream in an electrostatic precipitation process.

A more specific object of this invention is to reduce the amount of water soluble, iron salt dissolved in a water wash system for an electrostatic precipitator in an NGL processing system.

These and other objects and advantages of the present invention will become evident to those skilled in the art by reference to the following description and the appended claims.

DETAILED DESCRIPTION OF THE INVENTION

There is provided herein an improvement in a method for decreasing iron salt contamination in an NGL stream in which an NGL stream containing solid, iron salt contaminants and an aqueous wash stream are merged and contacted in an electrostatic precipitator thereby removing particulate solids of iron salts from the NGL stream and in which the aqueous wash stream is filtered to remove particulate solids and at least a portion thereof is recycled as at least a part of the aqueous wash stream. The improvement is maintaining the aqueous wash stream at a pH in a range to minimize the solubility of iron salts in the water thereby decreasing the amount of iron salts dissolved in water entrained in the NGL effluent of the electrostatic precipitator.

It should be noted that even though this invention is described in terms of iron salts, the most common solid contaminant for NGL streams, it is applicable to any compound the presence of which in solution can be prevented by raising the pH of the aqueous wash stream to the level of being basic.

Any material that can be used to increase the basicity of the aqueous wash stream, that does not interfere with the further treatment of the NGL, is suitable for employment in this invention. This includes compounds of the alkali metals and the alkaline earth metals. The preferred additives are chosen from, but not limited to, the alcohol amines, particularly the ethanolamines such as ethanolamine, diethanolamine, triethanolamine. Currently most preferred is ethanolamine because of its availability and ease of use in such a system.

The pH can be raised to any level of basicity, i.e. a level greater than 7.0, preferably from greater than 7.0 to 13.0, more preferably from greater than 7.0 to 11.0. It can be seen that the amount of additive needed will depend on the volume of water treated and the pH of the water to be treated.

The additive employed for increasing the pH of the aqueous wash stream is added either to the aqueous stream from which iron salt solids have been removed in the electrostatic precipitator, the fresh water supply or the aqueous wash stream after the fresh water supply and the aqueous stream from which iron salt solids have been removed have been merged.

The pH of the process is monitored by sampling the aqueous wash stream after the fresh water supply and the aqueous stream from which iron salt solids have been removed have been merged. The pH of the aqueous wash stream is adjusted in accordance therewith.

EXAMPLE I

The operability of the invention was tested by obtaining samples of the aqueous effluent from an electrostatic precipitator operating to treat an NGL stream by the process of this invention as described above but without the improvement set out herein. A bottle of the sampled water was poured into a flask and tested for pH using Litmus paper. The pH was 6. A dilute ethanolamine solution prepared by adding 0.80 gm of ethanolamine to deionized water and having a pH of 12 (by Litmus paper) was added to 74.7 gm of the sampled water in an amount of 0.8 gm. The solution turned black but appeared clear. The ethanolamine solution was added to the treated sampled water for a total amount of 0.91 gm. Some solids became visible. The ethanolamine solution was again added to the twice treated sample water to a total amount of 4.63 gm. The particles became larger but remained in suspension. The pH of the sampled water was 11 (by Litmus paper). The process was repeated three times with the same results. The particles were allowed to settle in the treated water and a clear liquid was decanted leaving a small amount of solids in the sampled water flask.

The addition of the ethanolamine caused a precipitate to form in the sampled water showing that the sampled water treated to raise the pH value did not retain material dissolved therein.

The invention thus being described, it will be obvious that the invention can be varied in many ways. Such variations are not to be regarded as a departure from the spirit and scope of the invention and all such modifications are intended to be included within the scope of the following claims.

That which is claimed is:

1. In a method for decreasing iron salts contamination in a natural gas liquid (NGL) stream which comprises:

(A) contacting the NGL stream containing iron salts with an aqueous wash stream to form an electrostatic precipitator feed stream, (B) passing the electrostatic precipitator feed stream through an electrostatic precipitator thereby removing iron salt solids from the NGL stream, (C) separating a stream of purified NGL, (D) separating an aqueous stream containing iron salt solids, (E) removing iron salt solids from the aqueous stream containing iron salt solids to provide an aqueous stream from which iron salt solids have been removed, (F) recycling, as at least a part of the aqueous wash stream, at least a portion of the aqueous stream from which iron salt solids have been removed:

the improvement of adding an amount of soluble base to the aqueous wash stream to maintain the aqueous wash stream at a pH sufficiently basic to decrease the solubility of iron salts in the aqueous wash stream thereby decreasing the iron salt contamination in the NGL stream.

2. A method according to claim 1 wherein the aqueous wash stream comprises a fresh water supply and the aqueous stream from which iron salt solids have been removed and the pH range of the aqueous wash stream is maintained by treating the aqueous stream from which iron salt solids have been removed with a soluble base.

3. A method of claim 2 wherein the soluble base is ethanolamine.

4. A method according to claim 2 wherein the pH of the aqueous wash stream produced by the merging of the fresh water supply and the aqueous stream from which iron salt solids have been removed is monitored and the pH of the aqueous wash stream adjusted to maintain a pH in a range above 7.0.

5. A method according to claim 1 wherein the aqueous wash stream comprises a fresh water supply and the aqueous stream from which iron salt solids have been removed and the pH range of the aqueous wash stream is maintained by treating the fresh water supply with a soluble base.

6. A method of claim 5 wherein the soluble base is ethanolamine.

7. A method according to claim 5 wherein the pH of the aqueous wash stream after the fresh water supply and the aqueous stream from which iron salt solids have been removed have been merged is monitored and the pH adjusted to maintain a pH in a range above 7.0.

8. A method according to claim 1 wherein the aqueous wash stream comprises a fresh water supply and the aqueous stream from which iron salt solids have been removed and the pH range of the aqueous wash stream is maintained by treating the aqueous wash stream by addition of a soluble base after the fresh water supply and the aqueous stream from which iron salt solids have been removed have been merged.

9. A method of claim 8 wherein the soluble base is ethanolamine.

10. A method according to claim 8 wherein the pH of the aqueous wash stream after the fresh water supply and the aqueous stream from which iron salt solids have been removed have been merged is monitored and the pH adjusted to maintain a pH in a range above 7.0.

11. A method according to claim 1 wherein the pH is in a range above 7.0.

12. A method according to claim 11 wherein the pH is in a range above 7.0 up to about 13.0.

13. A method according to claim 11 wherein the pH is in a range above 7.0 up to about 11.0.

* * * * *